US008730273B2

(12) United States Patent
Chu-Ke et al.

(10) Patent No.: US 8,730,273 B2
(45) Date of Patent: May 20, 2014

(54) RGBW DISPLAY APPARATUS AND CONTROL METHOD THEREOF

(75) Inventors: Hui Chu-Ke, Hsin-Chu (TW); Sheng-Wen Cheng, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 88 days.

(21) Appl. No.: 13/012,318

(22) Filed: Jan. 24, 2011

(65) Prior Publication Data

US 2012/0001947 A1 Jan. 5, 2012

(30) Foreign Application Priority Data

Jun. 30, 2010 (TW) ..... 99121597 A

(51) Int. Cl.
*G09G 5/10* (2006.01)

(52) U.S. Cl.
USPC ..... 345/690

(58) Field of Classification Search
None
See application file for complete search history.

(56) References Cited

U.S. PATENT DOCUMENTS 8,144,141 B2 * 3/2012 Hirose et al. ..... 345/209
2006/0050033 A1 * 3/2006 Asao et al. ..... 345/88
2006/0187386 A1 8/2006 Roh
2006/0214942 A1 9/2006 Tanase et al.
2006/0274212 A1 12/2006 Lo et al.
2009/0002298 A1 * 1/2009 Furukawa ..... 345/88
2010/0060670 A1 * 3/2010 Kuo ..... 345/690
2010/0321414 A1 * 12/2010 Muroi et al. ..... 345/690
2011/0090260 A1 * 4/2011 Chu Ke et al. ..... 345/690
2011/0148910 A1 * 6/2011 Botzas et al. ..... 345/600

FOREIGN PATENT DOCUMENTS

TW 200630680 A 9/2006
TW I295455 4/2008

OTHER PUBLICATIONS

Taiwan Patent Office, "Office Action", Aug. 13, 2013.

* cited by examiner

*Primary Examiner* — Bipin Shalwala
*Assistant Examiner* — Kwin Xie
(74) *Attorney, Agent, or Firm* — WPAT, PC; Justin King

(57) ABSTRACT

In an exemplary RGBW display apparatus, a plurality of four-color image output signals and a plurality of mapping scale ratios are generated according to a plurality of three-color image input signals. Furthermore, a backlight output intensity outputted from a backlight module is dynamically adjusted according to the mapping scale ratios and a white color signal adjust ratio is generated. In addition, a white color signal in each of the four-color image output signals is adjusted to be an updated white color signal according to the white color signal adjust ratio.

14 Claims, 13 Drawing Sheets

RGBW DISPLAY APPARATUS AND CONTROL METHOD THEREOF

BACKGROUND

1. Technical Field

The present invention is related to a display apparatus and its related control method, and more particularly to a RGBW display apparatus and its related control method.

2. Description of the Related Art

It is well-known that a display panel of liquid crystal display (LCD) apparatus generally is configured with a plurality of pixels each having a red color sub-pixel (R sub-pixel), a green color sub-pixel (G sub-pixel), and a blue color sub-pixel (B sub-pixel). The display apparatus composed by R sub-pixels, G sub-pixels and B sub-pixels is termed as a RGB display apparatus. In the RGB display apparatus, the size of each sub-pixel is ⅓ of the size of a single pixel.

With respect to portable display apparatus, high luminance and power saving capability are very important. Accordingly, a RGBW display apparatus which can increase transmittance and reduce backlight power consumption has been proposed. That is, each pixel in a display panel of the RGBW display apparatus is composed by a R sub-pixel, a G sub-pixel, a B sub-pixel and a W sub-pixel. In such RGBW display apparatus, the high transmittance of white sub-pixel is used to increase the luminance of the display apparatus and thereby achieving the effect of power saving.

However, in the display panel of such RGBW display apparatus, the size of each sub-pixel is smaller than the size of each sub-pixel in the conventional RGB display apparatus as described above. As a result, in the situation of the RGBW display apparatus is expected to display pure color or approximate pure color images, the luminance and chromaticity are worse than that of the conventional RGB display apparatus. In other words, because of the addition of the white sub-pixel in each pixel, the luminance and chromaticity are degraded in the use of displaying the pure color and approximate pure color images.

Since three-color image input signals received by the RGBW display apparatus each only includes a red color signal (R signal), a green color signal (G signal) and a blue color signal (B signal), and therefore in order to facilitate the RGBW display apparatus to achieve the display capability of luminance and chromaticity similar to that of the conventional RGB display apparatus, the control circuit in the RGBW display apparatus is necessary to adjust the backlight signal, and the R signal, the G signal and the B signal are needed to be further processed.

Referring to FIG. 1, showing a schematic functional block diagram of a conventional RGBW display apparatus. The RGBW display apparatus 100 includes a four-color mapping unit 110, a dynamic backlight control unit 120, a backlight driving unit 130, a backlight module 140, a source driver 170, a gate driver 180 and a pixel array 190. The pixel array 190 includes a plurality of pixel units 195 each having a data switch Qd, a liquid crystal capacitor Clc and a storage capacitor Cst. The source driver 170 provides a plurality of data signals SD1~SDm to the pixel array 190. The gate driver 180 provides a plurality of gate signals SG1~SGn for controlling the pixel units 195 to receive the data signals SD1~SDn and thereby cooperative with a backlight output intensity provided by the backlight module 140 to display an image on the pixel array 190.

The four-color mapping unit 110 receives three-color image input signals (Ri, Gi, Bi), and a pre-mapping lookup table 111 in the four-color mapping unit 110 is stored with a plurality of mapping scale ratios Ssca. That is, the pre-mapping lookup table 111 outputs the corresponding mapping scale ratios Ssca according to the received three-color image input signals (Ri, Gi, Bi) and thereby generates first set of four-color image signals.

The dynamic backlight control unit 120 receives the mapping scale ratios Ssca, and a scale ratio analyzing unit 121 in the dynamic backlight control unit 120 computes the mapping scale ratios Ssca and thereby outputs an analyzing value Sana according to the statistical computation result. A backlight adjust lookup table 123 in the dynamic backlight control unit 120 provides a backlight adjust signal Sadj to the backlight driving unit 130 according to the analyzing value Sana. A working cycle adjust unit 135 in the backlight driving unit 130 adjusts a pulse width modulation signal Spwm according to the backlight adjust signal Sadj. The backlight module 140 modulates the backlight output intensity according to the pulse width modulation signal Spwm.

Moreover, the dynamic backlight control unit 120 also would produce a mappingss correction signal Scorr to the four-color mapping unit 110. The four-color mapping unit 110 would adjust the first set of four-color image signals to be second set of four-color image signals (R', G', B', W').

After the source driver 170 receives the second set of four-color image signals (R', G', B', W'), the source driver 170 would generate the data signals SD1~SDm to the pixel array 190 for image display.

It is found from the above description that the pre-mapping lookup table 111 in the conventional four-color mapping unit 110 needs firstly to map the three-color image input signals (Ri, Gi, Bi) into the first set of four-color image signals, and then adjusts the first set of four-color image signals into the second set of four-color image signals (R',G', B', W') according to the mapping correction signal Scorr. That is, owing to the mapping correction signal Scorr, all color signals in the first set of four-color image signals would be adjusted to be the second set of four-color image signals (R', G', B', W'), and therefore the pre-mapping lookup table 111 is inevitably to record a large amount of corresponding data and thus the required memory volume is very big, so that the design of the pre-mapping lookup table 111 is very complex.

SUMMARY OF THE INVENTION

The present invention is related to a four-primary-color display apparatus and its related control method, which can use a relatively small memory volume to achieve the purpose of mapping three-color image input signals to four-color image output signals.

More specifically, a four-primary-color display apparatus in accordance with an embodiment of the present invention comprise a four-color mapping unit, a dynamic backlight control unit, a backlight module, a source driver and a pixel array. The four-color mapping unit is for receiving a plurality of three-color image input signals and correspondingly generating a plurality of mapping scale ratios and thereby generating a plurality of four-color image output signals. Each of the four-color image output signals comprises a first color signal, a second color signal, a third color signal and a white color signal. The dynamic backlight control unit is electrically connected to the four-color mapping unit and for receiving and computing the mapping scale ratios and thereby outputting a backlight adjust signal and a white color signal adjust ratio. The four-color mapping unit adjusts the white color signal to be an updated white color signal according to the white color signal adjust ratio. The backlight module is electrically connected to the dynamic backlight control unit and for receiving the backlight adjust signal and thereby outputting a backlight output intensity. The source driver is electrically connected to the four-color mapping unit and for receiving the first color signal, the second color signal, the third color signal and the updated white color signal outputted from the four-color mapping unit and thereby producing a plurality of data signals. The pixel array is electrically connected to the source driver and for displaying an image according to the data signals and the backlight output intensity.

A control method of a four-primary-color display apparatus in accordance with an embodiment of the present invention comprises steps of: receiving a plurality of three-color image input signals; producing a plurality of mapping scale ratios and a plurality of four-color image output signals according to the three-color image input signals and a re-mapping lookup table, wherein each of the four-color image output signals comprises a first color signal, a second color signal, a third color signal and a white color signal; computing the mapping scale ratios and thereby outputting a backlight adjust signal and a white color signal adjust ratio; controlling a backlight module to produce a backlight output intensity according to the backlight adjust signal; adjusting the white color signal to be an updated white color signal according to the white color signal adjust ratio; and displaying an image on a pixel array according to the backlight output intensity and the first color signal, the second color signal, the third color signal and the updated white color signal.

A four-primary-color display apparatus in accordance with another embodiment of the present invention comprises: a four-color mapping unit, a saturation mapping unit, a dynamic backlight control unit, a backlight module, a source driver and a pixel array. The four-color mapping unit is for receiving a plurality of three-color image input signals and generating a plurality of four-color image output signals. Each of the four-color image output signals comprises a first color signal, a second color signal, a third color signal and a white color signal. The saturation mapping unit is for receiving the three-color image input signals and mapping the three-color image input signals to be a plurality of saturation values. The dynamic backlight control unit is electrically connected to the saturation mapping unit and for receiving and computing the saturation values and outputting a backlight adjust signal and a white color signal adjust ratio. The four-color mapping unit adjusts the white color signal to be an updated white color signal according to the white color signal adjust ratio. The backlight module is electrically connected to the dynamic backlight control unit and for receiving the backlight adjust signal and thereby generating a backlight output intensity. The source driver is electrically connected to the four-color mapping unit and for receiving the first color signal, the second color signal, the third color signal and the updated white color signal outputted from the four-color mapping unit and thereby generating a plurality of data signals. The pixel array is electrically connected to the source driver and for displaying an image according to the data signals and the backlight output intensity.

A control method of a four-primary-color display apparatus in accordance with still another embodiment of the present invention comprises steps of: receiving a plurality of three-color image input signals; mapping the three-color image input signals to be a plurality of four-color image output signals according to a re-mapping lookup table, wherein each of the four-color image output signals comprises a first color signal, a second color signal, a third color signal and a white color signal; mapping the three-color image input signals to be a plurality of saturation values; computing the saturation values and thereby outputting a backlight adjust signal and a white color signal adjust ratio; controlling a backlight module to generate a backlight output intensity according to the backlight adjust signal; adjusting the white color signal to be an updated white color signal according to the white color signal adjust ratio; and displaying an image on a pixel array according to the backlight output intensity and the first color signal, the second color signal, the third color signal and the updated white color signal.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
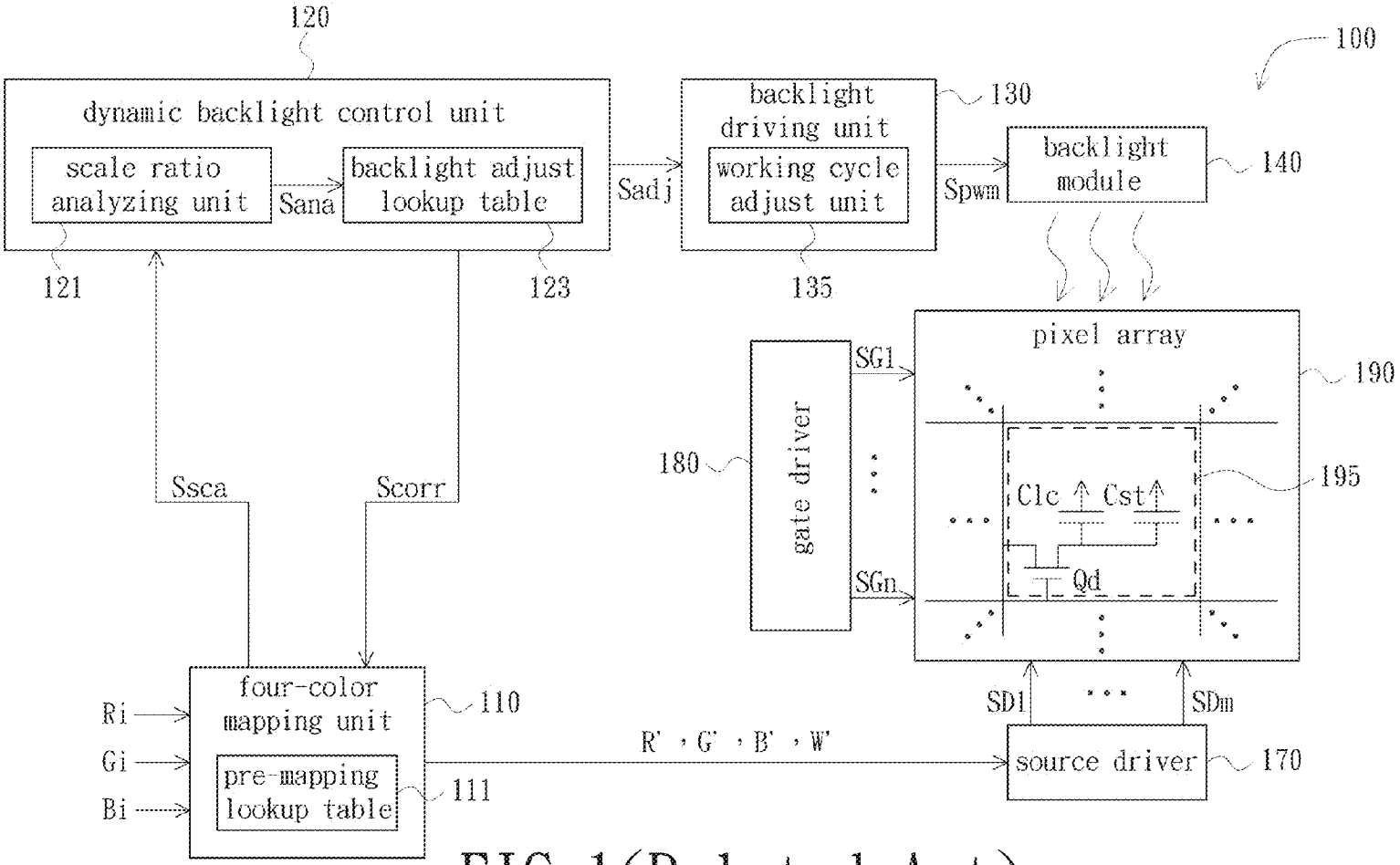
FIG. 1 (Related Art)
FIG. 1 is a schematic functional block diagram of a conventional RGBW display apparatus.
Figure 2:
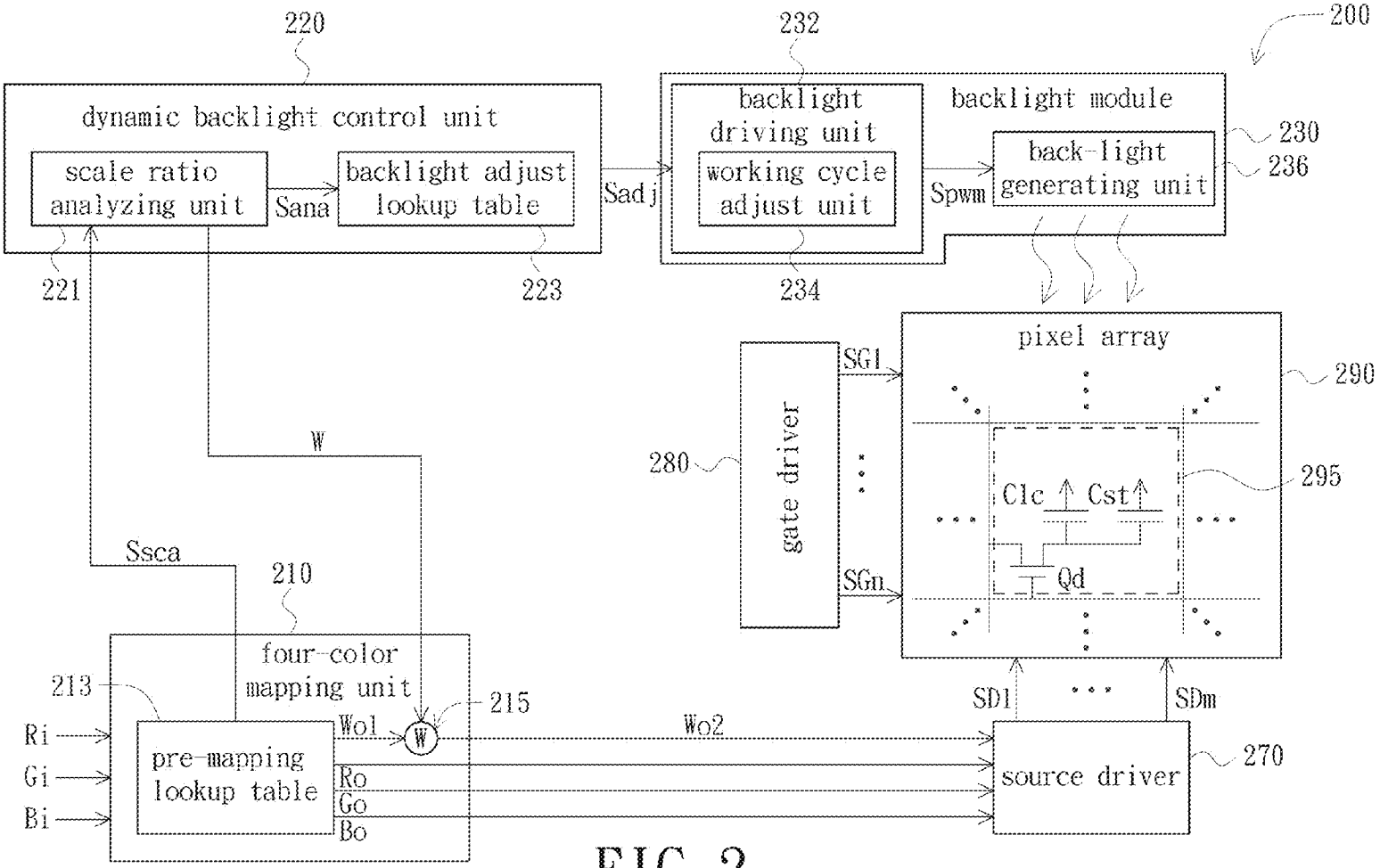
FIG. 2 is a schematic functional block diagram of a RGBW display apparatus in accordance with a first embodiment of the present invention.

Referring to FIG. 2, showing a schematic functional block diagram of a RGBW display apparatus in accordance with a first embodiment of the present invention. The RGBW display apparatus 200 includes a four-color mapping unit 210, a dynamic backlight control unit 220, a backlight module 230, a source driver 270, a gate driver 280 and a pixel array 290. The pixel array 290 includes a plurality of pixel units 295 (FIG. 2 only shows one for the purpose of illustration) each having a data switch Qd, a liquid crystal capacitor Clc and a storage capacitor Cst. The source driver 270 provides a plurality of data signals SD1~SDm to the pixel array 290 for image display. The gate driver 280 provides a plurality of gate signals SG1~SGn for controlling the pixel units 295 in the pixel array 290 to receive the data signals SD1~SDm and thereby cooperative with a backlight output intensity provided by the backlight module 230 to display an image on the pixel array 290.

The four-color mapping unit 210 receives three-color image input signals (Ri, Gi, Bi), and a pre-mapping lookup table 213 in the four-color mapping unit 210 is stored a plurality of corresponding mapping scale ratios Ssca. That is, the pre-mapping lookup table 213 would output corresponding mapping scale ratios Ssca according to the received three-color image input signals (Ri, Gi, Bi) and thereby generates four-color image output signals, herein each of the four-color image output signals includes a white color signal Wo1, a red color signal Ro, a green color signal G0 and a blue color signal Bo.

The dynamic backlight control unit 220 receives the mapping scale ratios Ssca, and a scale ratio analyzing unit 221 in the dynamic backlight control unit 220 computes the mapping scale ratios Ssca and thereby outputs an analyzing value Sana and a white color signal adjust ratio W according to the statistical computation result. A backlight adjust lookup table 223 in the dynamic backlight control unit 220 then provides a backlight adjust signal Sadj to the backlight module 230 according to the analyzing value Sana.

The backlight module 230 includes a backlight driving unit 232 and a backlight generating unit 236. Moreover, a working cycle adjust unit 234 in the backlight driving unit 232 would adjust a pulse width modulation signal (Spwm) according to the backlight adjust signal Sadj, and the backlight generating unit 236 then would modulate the backlight output intensity according to the pulse width modulation signal Spwm.

According to the first embodiment of the present invention, the white color signal adjust ratio W generated by the scale ratio analyzing unit 221 in the dynamic backlight control unit 220 would be transmitted to the four-color mapping unit 210, a multiplication unit 215 in the four-color mapping unit 210 would multiply the white color signal Wo1 in each the four-color image output signal by the white color signal adjust ratio W and thereby obtaining an updated white color signal Wo2. In other words, the source driver 270 would receive the updated white color signal W02, the red color signal R0, the green color signal G0 and the blue color signal Bo and thereby produces the data signals SD1~SDm to the pixel array 290 for image display.

In the following, detailed operation principles of all the above elements will be described in detailed. Since the size of sub-pixel in the RGBW display apparatus 200 is relatively smaller than that in the conventional RGB liquid crystal display panel, in order to achieve the same display capability of luminance and chromaticity as the conventional RGB liquid crystal display panel, the pre-mapping lookup table 213 would scales the inputted three-color image input signals (Ri, Gi, Bi) and then generates the four-color image output signals (Wo1, Ro, Go, Bo) and corresponding mapping scale ratios Ssca.

Basically, the mapping scale ratios Ssca fall in the range of 1~2. If an inputted three-color image input signal (Ri, Gi, Bi) is close to pure color, the mapping scale ratio Ssca is near to 1, whereas if the inputted three-color image input signal (Ri, Gi, Bi) is impure color, the mapping scale ratio Ssca would be near to 2. For example, if the inputted three-color image input signal (Ri, Gi, Bi) is pure color (red color, green color, blue color), the mapping scale ratio Ssca is 1; and if the inputted three-color image input signal (Ri, Gi, Bi) is white color, the mapping scale ratio Ssca is 2. The pre-mapping lookup table 213 would provide different mapping scale ratios Ssca according to different three-color image input signals (Ri, Gi, Bi).

Moreover, it is assumed that a panel resolution of the RGBW display apparatus 200 is 1024×768. For each frame, the RGBW display apparatus 200 would sequentially receive 1024×768 number of three-color image input signals (Ri, Gi, Bi) and correspondingly generate 1024×768 number of four-color image output signals (Wo1, Ro, Go, Bo) and 1024×768 number of mapping scale ratios Ssca to the scale ratio analyzing unit 221.

The scale ratio analyzing unit 221 would compute all received mapping scale ratios Ssca and then determine the frame is either a pure color frame or am impure color frame. According to the first embodiment of the present invention, if the frame is determined to be an pure color frame, the backlight generating unit 236 in the backlight module 230 must increase the backlight output intensity, and the white color signal Wo1 in the four-color image output signal (Wo1, Ro, Go, Bo) is adjusted to be an updated white color signal Wo2 so as to match the increase of the backlight output intensity. Whereas, if the frame is determined to be near the impure color frame, the backlight generating unit 236 in the backlight module 230 must decrease the backlight output intensity and the white color signal Wo1 in the four-color image output signal (Wo1, Ro, Go, Bo) is adjusted to be an updated white color signal Wo2 so as to match the decrease of the backlight output intensity.

Figures 3A, 3B, 3C:
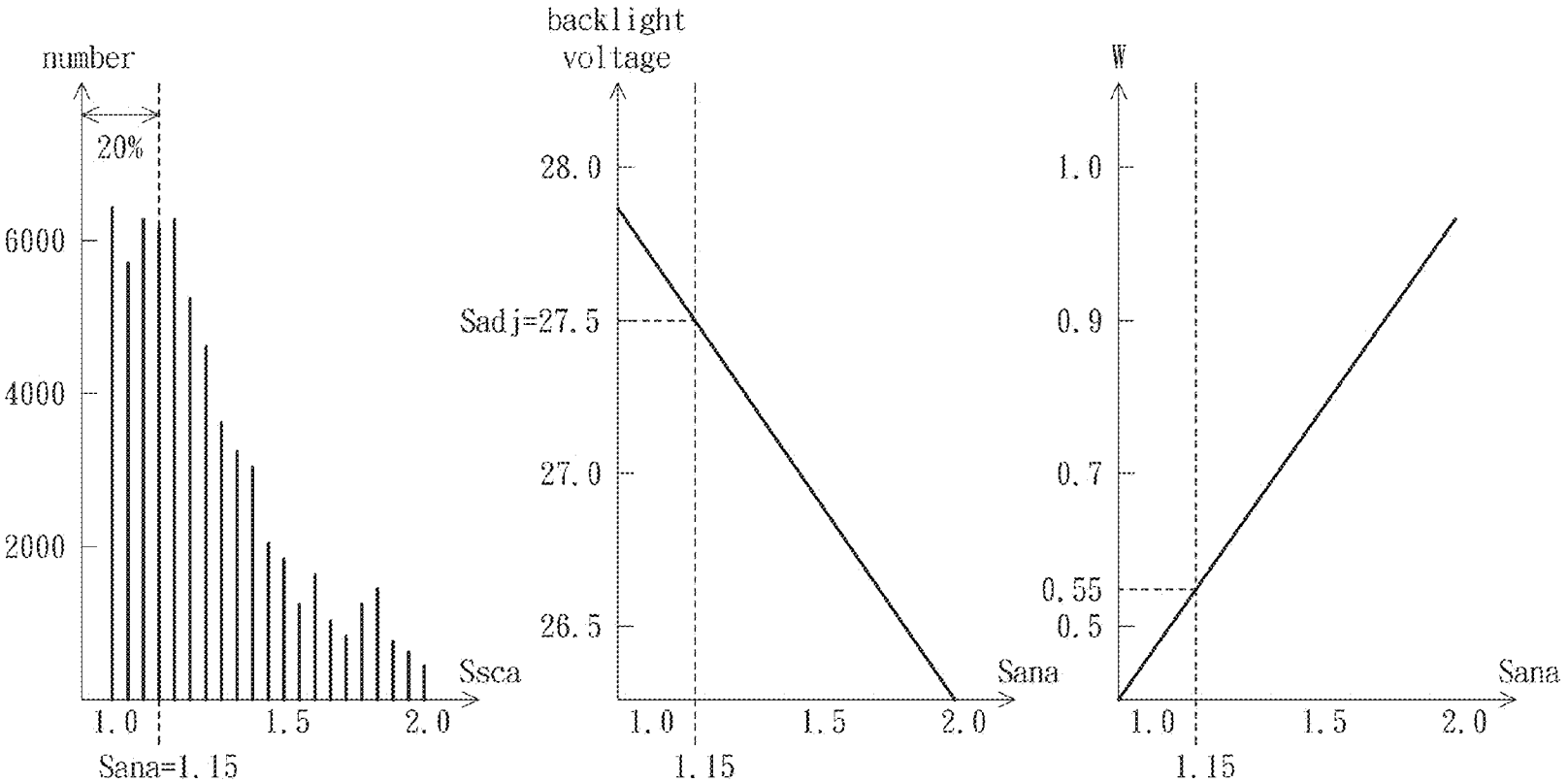
FIGS. 3A to 3C show an operation principle of an scale ratio analyzing unit when the frame is with a relatively high ratio of pure color.

Referring to FIGS. 3A to 3C, showing an operation principle of the scale ratio analyzing unit when the frame is with a high ratio of pure color. Since the ratio of pure color in the frame is relatively high, most of the mapping scale ratios Ssca would be close to 1. According to an embodiment of the present invention, when the scale ratio analyzing unit 221 accumulates the mapping scale ratios to 1.15, the number of the mapping scale ratios Ssca has been up to 20% of the total number (i.e., 1024×768×20%). Accordingly, an analyzing value Sana outputted from the scale ratio analyzing unit 221 is 1.15. Since the analyzing value is close to 1, it can be determined that the ratio of pure color in the frame is relatively high. Subsequently, the backlight adjust lookup table 223 will generate a backlight adjust signal Sadj representing 27.5V according to the analyzing value Sana of 1.15, which makes in the backlight module 230 that the working cycle adjust unit 234 of the backlight driving unit 232 generates a corresponding pulse width modulation signal Spwm and the backlight generating unit 235 increases the backlight output intensity. Moreover, the scale ratio analyzing unit 221 also would output a white color signal adjust ratio W of 0.55 according to the analyzing value Sana of 1.15 to the four-color mapping unit 210, so that the white color signal Wo1 is multiplied by the white color signal adjust ratio W of 0.55 to obtain an updated white color signal Wo2. Finally, the source driver 270 receives the updated white color signal Wo2, the red color signal Ro, the green color signal Go and the blue color signal Bo, and thereby generates the data signals SD1~SDm to the pixel array 290 for image display.

Figures 4A, 4B, 4C:
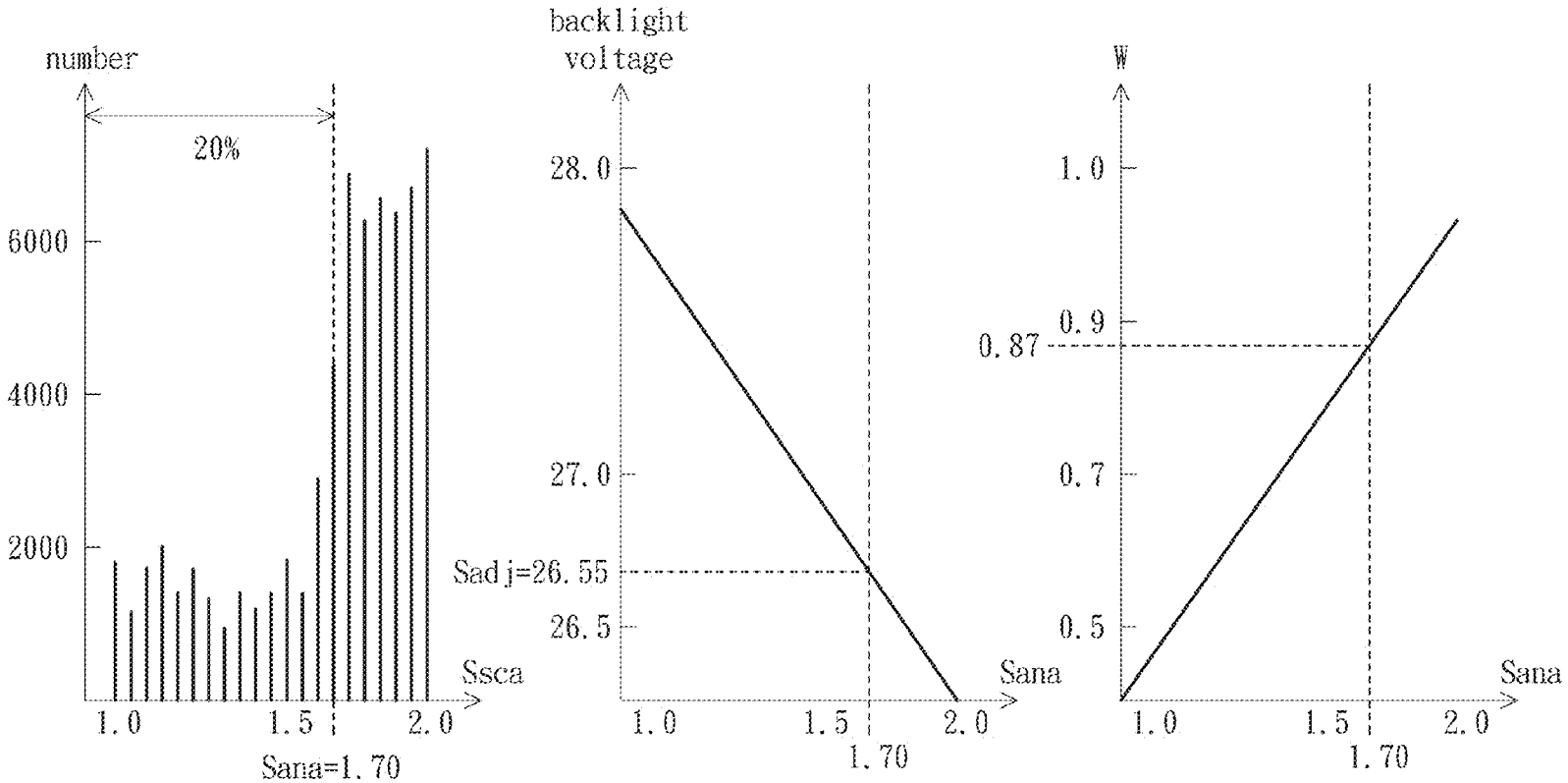
FIGS. 4A to 4C show an operation principle of an scale ratio analyzing unit when the frame is with a relatively high ratio of impure color.

Referring to FIGS. 4A to 4C, showing an operation principle of the scale ratio analyzing unit when the frame is with a high ratio of impure color. Since the ratio of impure color in the frame is relatively high, most of mapping scale ratios Ssca would be close to 2. According to an embodiment of the present invention, when the scale ratio analyzing unit 221 accumulates the mapping scale ratios to 1.70, the number of mapping scale ratios Ssca has been up to 20% of the total number (i.e., 1024×768×20%). Accordingly, the analyzing value outputted from the scale ratio analyzing unit 221 is 1.70. Since the analyzing value Sana is close to 2, it can be determined that the ratio of impure color in the frame is relatively high. Subsequently, the backlight adjust lookup table 223 will generate a backlight adjust signal Sadj representing 26.55V according to the analyzing value Sana of 1.70, which makes in the backlight module 230 that the working cycle adjust unit 234 of the backlight driving unit 232 generates a corresponding pulse width modulation signal Spwm and the backlight generating unit 236 decreases the backlight output intensity. Moreover, the scale ratio analyzing unit 221 also would output a white color signal adjust ratio W of 0.87 according to the analyzing value Sana of 1.70 to the four-color mapping unit 210, so that the white color signal Wo1 is multiplied by the white color signal adjust ratio W of 0.87 to obtain an updated white color signal Wo2. Finally, the source driver 270 receives the updated white color signal Wo2, the red color signal Ro, the green color signal Go and the blue color signal Bo, and thereby generates the data signals SD1~SDm to the pixel array 290 for image display.

It is found from the above description that, in the first embodiment of the present invention, the RGBW display apparatus 200 uses the scale ratio analyzing unit 221 in the dynamic backlight control unit 220 to generate the analyzing value Sana and the white color signal adjust ratio W. The analyzing value Sana then is used to control the backlight output intensity produced by the backlight module 230. Meanwhile, the white color signal adjust ratio W is used to adjust the white color signal Wo1 in each the four-color image output signal to be the updated white color signal Wo2, while the red color signal Ro, the green color signal Go and the blue color signal Bo in the four-color image output signal do not made any adjustment. Therefore, the pre-mapping lookup table 213 only is needed to mapping the three-color image input signals (Ri, Gi, Bi) into the four-color image output signals (Wo1, Ro, Go, Bo) and thus the required memory volume of the pre-mapping lookup table 213 can be dramatically reduced.

Figure 5:
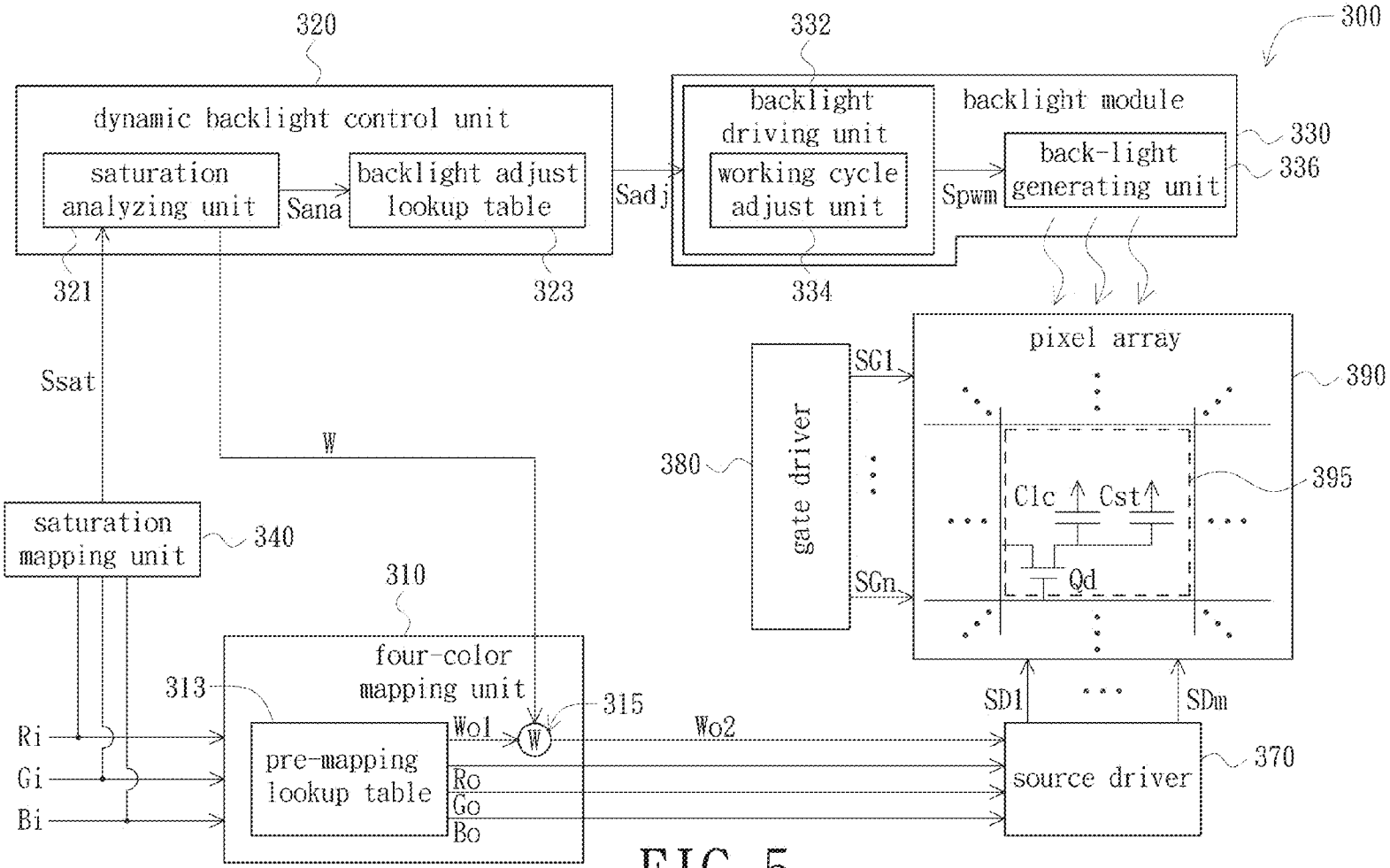
FIG. 5 is a schematic functional block diagram of a RGBW display apparatus in a second embodiment of the present invention.

Referring to FIG. 5, showing a schematic functional block diagram of a RGBW display apparatus in accordance with a second embodiment of the present invention. The RGBW display apparatus 300 includes a four-color mapping unit 310, a saturation mapping unit 340, a dynamic backlight control unit 320, a backlight module 330, a source driver 370, a gate driver 380 and a pixel array 390. The pixel array 390 includes a plurality of pixel units 395 each having a data switch Qd, a liquid crystal capacitor Clc and a storage capacitor Cst. The source driver 370 provides a plurality of data signals SD1~SDm to the pixel array 390 for image display. The gate driver 380 provides a plurality of gate signals SG1~SGn for controlling the pixel units 395 to receive the data signals SD1~SDm and thereby cooperative with a backlight output intensity provided by the backlight module 330 to display an image on the pixel array 390.

The four-color mapping unit 310 receives three-color image input signals (Ri, Gi, Bi), and a pre-mapping lookup table 313 in the four-color mapping unit 310 maps the received three-color image input signals (Ri, Gi, Bi) into four-color image output signals. Each the four-color image output signal includes a white color signal Wo1, a red color signal Ro, a green color signal Go and a blue color signal Bo.

The saturation mapping unit 340 receives the three-color image input signals (Ri, Gi, Bi), performs a mapping between the RGB color space and the hue-saturation-luminance (HSL) color space and thereby outputs corresponding saturation values Ssat to the dynamic backlight control unit 320.

The dynamic backlight control unit 320 receives the saturation values S sat, and a saturation value analyzing unit 321 in the dynamic backlight control unit 320 computes the saturation values Ssat and thereby outputs an analyzing value Sana and a white color signal adjust ratio W according to the statistical computation result. A backlight adjust lookup table 323 in the dynamic backlight control unit 320 then provides a backlight adjust signal Sadj according to the analyzing value Sana to the backlight module 330.

Moreover, the backlight module 330 includes a backlight driving unit 332 and a backlight generation unit 336. A working cycle adjust unit 334 in the backlight driving unit 332 would adjust a pulse width modulation signal Spwm according to the backlight adjust signal Sadj and the backlight generating unit 336 then adjust the backlight output intensity according to the pulse width modulation signal Spwm.

According to an embodiment of the present invention, the white color signal adjust ration W generated by the saturation value analyzing unit 321 in the dynamic backlight control unit 320 will be delivered to the four-color mapping unit 310. A multiplication unit 315 in the four-color mapping unit 310 will make the white color signal Wo1 in each the four-color image output signal be multiplied by the white color signal adjust ratio W and thereby obtaining an updated white color signal Wo2. In other words, the source driver 370 will receive the updated white color signal Wo2, the red color signal Ro, the green color signal Go and the blue color signal Bo and thereby generates the data signals SD1~SDm to the pixel array 390 for image display.

In the following, detailed operation principles of all the elements will be described in detailed. Since the size of sub-pixel in the RGBW display apparatus 300 is smaller than that in the conventional RGB liquid crystal display panel, in order to achieve the same display capability of luminance and chromaticity as the conventional RGB liquid crystal display panel, the pre-mapping lookup table 313 would scale the inputted three-color image input signals (Ri, Gi, Bi) and generates corresponding four-color image output signals (Wo1, Ro, Go, Bo).

The saturation mapping unit 340 maps the received three-color image input signals (Ri, Gi, Bi) to be HSL color space, and outputs corresponding saturation values Ssat. Each of the saturation values Ssat can be calculated from the following equation that: Ssat=[max(Ri,Gi,Bi)−min(Ri,Gi,Bi)]/max(Ri, Gi,Bi). That is, the saturation value Ssat is obtained by using the maximum color signal in the three-color image input signal (Ri, Gi, Bi) to subtract the minimum color signal in the three-color image input signal (Ri, Gi, Bi) and then the difference is divided by the maximum color signal. Clearly, when a three-color image input signal (Ri, Gi, Bi) is close to pure color, the saturation value would be close to 1; whereas when the three-color image input signal (Ri, Gi, Bi) is close to impure color, the saturation value would be close to 0.

Figure 6B:
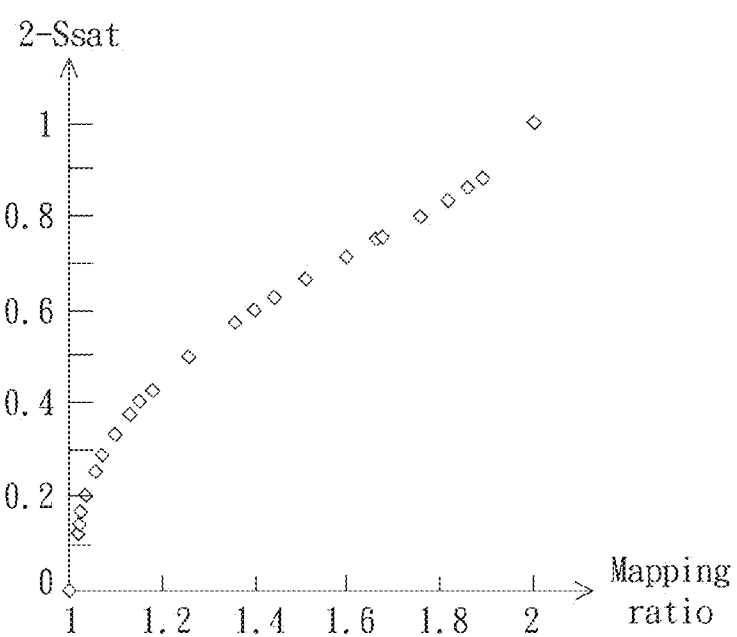
FIG. 6B is a mapping chart in accordance with 2-saturation value Ssat and a mapping ratio.
Figure 6A:
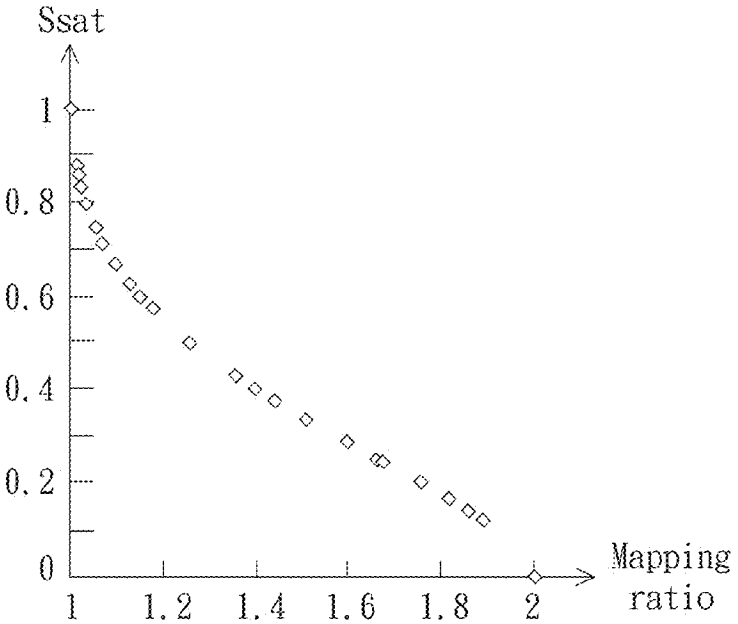
FIG. 6A is a mapping chart in accordance with a saturation value Ssat and a mapping ratio.

According to the second embodiment of the present invention, the saturation value analyzing unit 321 needs firstly to convert the saturation values Ssat into mapping ratios. When the three-color image input signal (Ri, Gi, Bi) is close to pure color, the saturation value Ssat is relatively high and the mapping ratio is relatively low. Whereas, when the three-color image input signal (Ri, Gi, Bi) is close to impure color, the saturation value Ssat is relatively low and the mapping ratio is relatively high. Referring to FIG. 6A, showing a mapping chart in accordance with saturation value Ssat and mapping ratio. As illustrated in FIG. 6A, the saturation value is inversely proportional to the mapping ratio. Of course, referring to the mapping chart in accordance with (2-Ssat) and the mapping ratio as illustrated in FIG. 6B, the (2-Ssat) is directly proportional to the mapping ratio.

According to the second embodiment of the present invention, the mappings between the saturation values S sat and the mapping ratios are performed by the saturation value analyzing unit 321 in the dynamic backlight control unit 320. Of course, the mappings also can be processed by the saturation value mapping unit 340, that is, the saturation mapping unit 340 directly outputs mapping ratios to the saturation value analyzing unit 321 for statistical computation.

Furthermore, the mapping ratios fall in the range of 1~2. If an inputted three-color image input signal (Ri, Gi, Bi) is close to pure color, the mapping ratio is close to 1, whereas if the inputted three-color image input signal (Ri, Gi, Bi) is impure color, the mapping ratio is close to 2. For example, if the inputted three-color image input signal (Ri, Gi, Bi) is pure color (red color, green color, blue color), the mapping ratio is 1; if the inputted three-color image input signal (Ri, Gi, Bi) is white color, the mapping ratio is 2.

Furthermore, it is assumed that a panel resolution of the RGBW display apparatus 300 is 1024×768. For each frame, the RGBW display apparatus 200 would sequentially receive 1024×768 number of three-color image input signals (Ri, Gi, Bi), and correspondingly the saturation mapping unit 340 would generate 1024×768 number of saturation values Ssat to the saturation value analyzing unit 321, then the saturation value analyzing unit 321 would perform a statistical computation to mapping ratios mapped from the saturation values.

In other words, the saturation value analyzing unit 321 computes all the mapping ratios and determines a frame is close to either a pure color frame or an impure color frame. According to the second embodiment of the present invention, if the frame is close to a pure color frame, the backlight generating unit 336 in the backlight module 330 must increase the backlight output intensity and the white color signal Wo1 in the four-color image output signal (Wo1, Ri, Gi, Bi) is adjusted to be an updated white color signal Wo2 for matching the increase of backlight output intensity. Whereas, if the frame is close to an impure color frame, the must decrease the backlight output intensity and the white color signal Wo1 in the four-color image output signal (Wo1, Ri, Gi, Bi) is adjusted to be an updated white color signal Wo2 for matching the decrease of backlight output intensity.

Figures 7A, 7B, 7C:
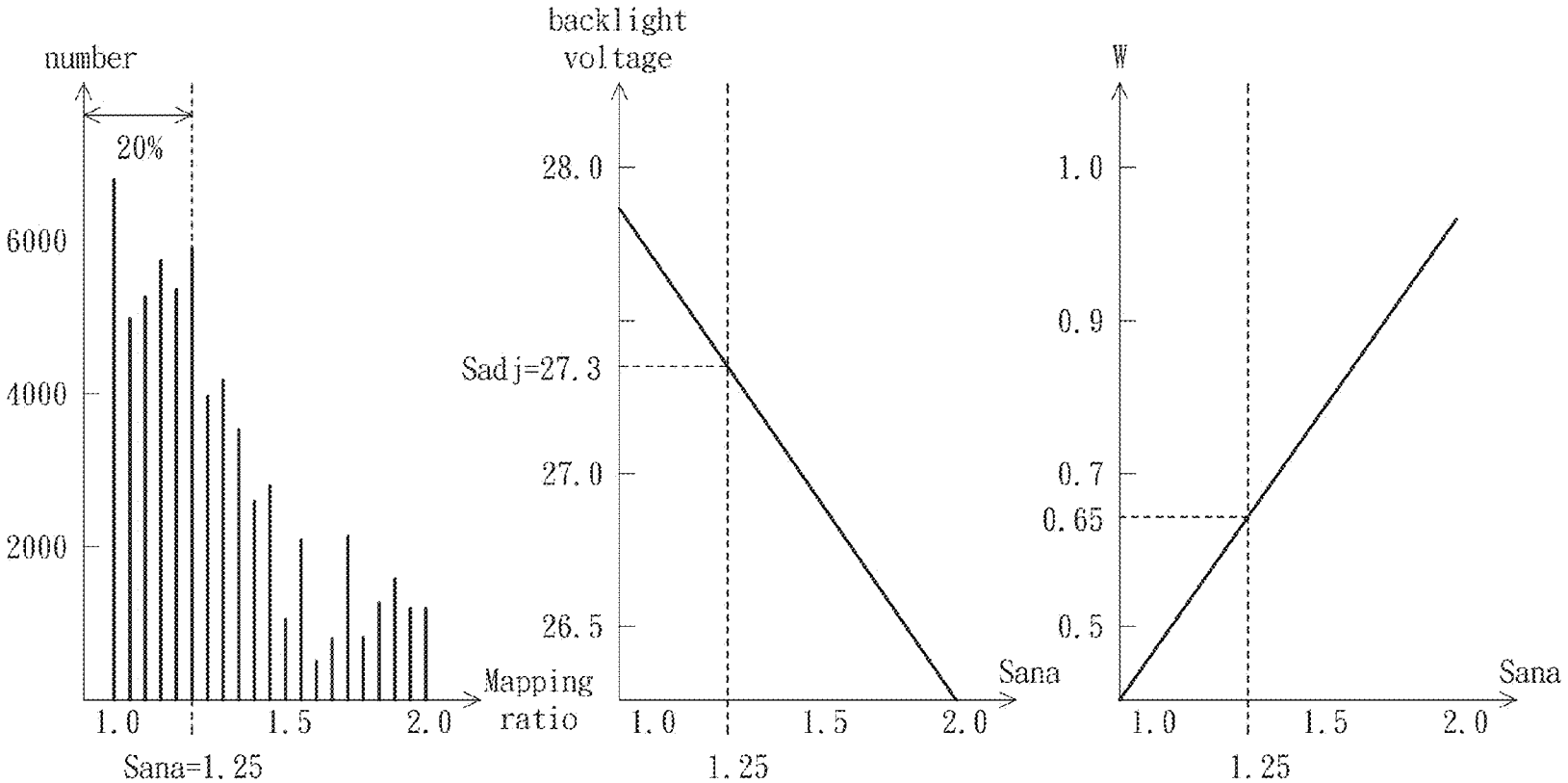
FIGS. 7A to 7C show an operation principle of a saturation analyzing unit when the ratio of pure color in the frame is relatively high.

Referring to FIGS. 7A to 7C, showing an operation principle of the saturation value analyzing unit when the frame is with a relatively high ratio of pure color. Because the ratio of pure color in the frame is relatively high, most of mapping ratios would be close to 1. According to the second embodiment of the present invention, when the saturation value analyzing unit 321 accumulates the mapping ratios to 1.25, the number of the accumulated mapping ratios has been up to 20% of the total number (1024×768×20%). Therefore, the analyzing value Sana outputted from the saturation value analyzing unit 321 is 1.25. Since the analyzing value Sana is close to 1, it can be determined that the ratio of pure color in the frame is relatively high. Subsequently, the backlight adjust lookup table 323 generates the backlight adjust signal Sadj representing 27.3V according to the analyzing value Sana of 1.25, which makes in the backlight module 330 that the working cycle adjust unit 334 in the backlight driving unit 332 generates a corresponding pulse width modulation signal Spwm and the backlight generating unit 336 increases the backlight output intensity. Moreover, the saturation value analyzing unit 321 also would output a white color signal adjust ratio W according to the analyzing value Sana of 1.25 to the four-color mapping unit 310, so that the white color signal Wo1 is multiplied by the white color signal adjust ratio W of 0.65 to produce an updated white color signal Wo2. Finally, the source driver 370 receives the updated white color signal Wo2, the red color signal Ro, the green color signal G0 and the blue color signal Bo and thereby generates the data signals SD1~SDm to the pixel array 390 for image display.

Figures 8A, 8B, 8C:
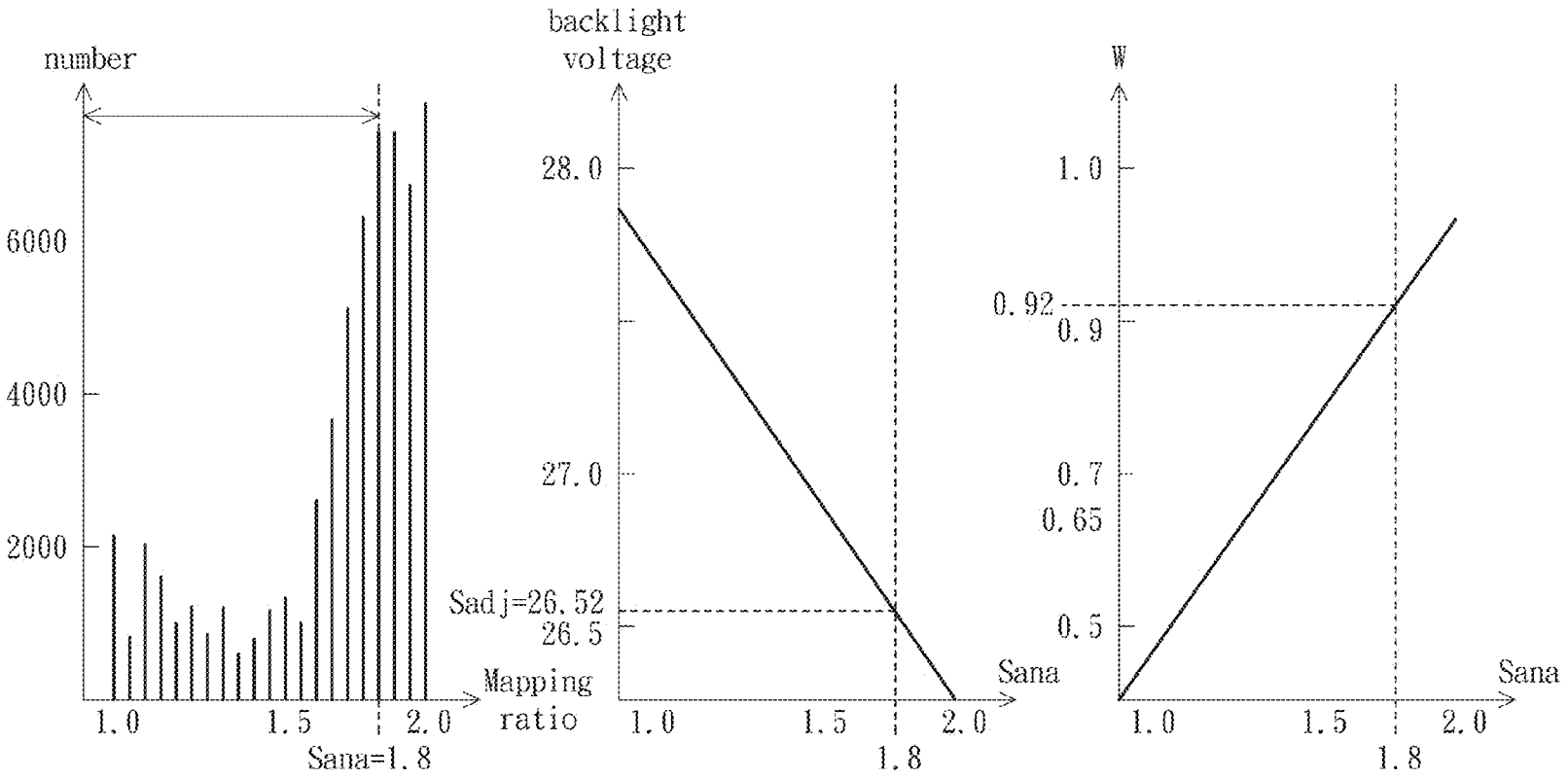
FIGS. 8A to 8C show an operation principle of a saturation analyzing unit when the ratio of impure color in the frame is relatively high.

Referring to FIGS. 8A to 8C, showing an operation principle of the saturation value analyzing unit when the frame is with a relatively high ratio of impure color. Because the ratio of impure color in the frame is relatively high, most of mapping ratios would be close to 2. According to an embodiment of the present invention, when the saturation value analyzing unit 321 accumulates the mapping ratios to 1.80, the number of the accumulated mapping ratios has been up to 20% of the total number (1024×768×20%). Therefore, the analyzing value Sana outputted from the saturation value analyzing unit 321 is 1.80. Since the analyzing value Sana is close to 2, it can be determined that the ratio of impure color in the frame is relatively high. Subsequently, the backlight adjust lookup table 323 generates the backlight adjust signal Sadj representing 26.52V according to the analyzing value Sana of 1.80, which makes in the backlight module 330 that the working cycle adjust unit 334 in the backlight driving unit 332 generates a corresponding pulse width modulation signal Spwm and the backlight generating unit 336 decreases the backlight output intensity. Moreover, the saturation value analyzing unit 321 also would output a white color signal adjust ratio W of 0.92 according to the analyzing value Sana of 1.80 to the four-color mapping unit 310, so that the white color signal Wo1 is multiplied by the white color signal adjust ratio W of 0.92 to produce an updated white color signal Wo2. Finally, the source driver 370 receives the updated white color signal Wo2, the red color signal Ro, the green color signal G0 and the blue color signal Bo and thereby generates the data signals SD1~SDm to the pixel array 390 for image display.

It is found from the above description that, in the second embodiment of the present invention, the RGBW display apparatus uses the saturation values Ssat to generate the analyzing value Sana and the white color signal adjust ratio W. The analyzing value Sana then is used to control the backlight output intensity produced by the backlight module 330. Meanwhile, the white color signal adjust ratio W is used to adjust the white color signal Wo1 in the four-color image output signal to be the updated white color signal Wo2. In another aspect, the red color signal Ro, the green color signal Go and the blue color signal Bo in the four-color image output signal are not made any adjustment. Accordingly, the pre-mapping lookup table 313 only is required to map the three-color image input signals to the four-color image output signals, and thus the required memory volume of the pre-mapping lookup table 313 can be dramatically reduced.

Figure 9A:
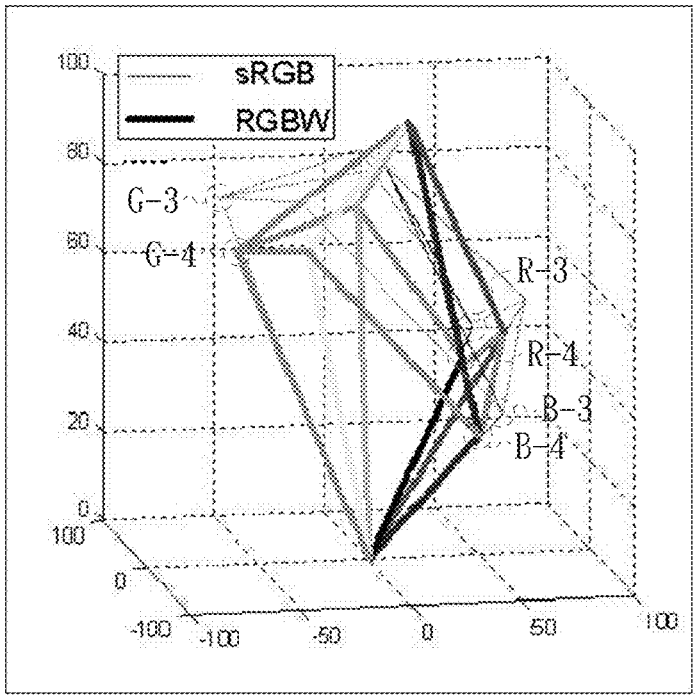
FIGS. 9A and 9B respectively are display effects in color gamut range of a conventional RGB display apparatus and the present RGBW display apparatus.

In the following, display effects in the CIELAB color space achieved by the RGBW display apparatus and its related control method in accordance with the present invention will be described. As illustrated in FIG. 9A, at the prerequisite of same backlight output intensities, a pure color luminance displayed by the RGBW display apparatus is worse than that displayed by the conventional RGB display apparatus. That is, in the CLELAB color space, a position of green pure color (G-4) in the RGBW display apparatus is lower than the position of green pure color (G-3) in the conventional RGB display apparatus, a position of red pure color (R-4) in the RGBW display apparatus is lower than the position of red pure color (R-3) in the conventional RGB display apparatus, and a position of blue pure color (B-4) in the RGBW display apparatus is lower than the position of blue pure color (B-3) in the conventional RGB display apparatus.

Moreover, a range of a* value in the RGBW display apparatus is smaller than that in the conventional RGB display apparatus, a range of b* value in the RGBW display apparatus also is smaller than that in the conventional RGB display apparatus. That is, a chromaticity displayed by the RGBW display apparatus is worse than that displayed by the conventional RGB display apparatus.

Figure 9B:
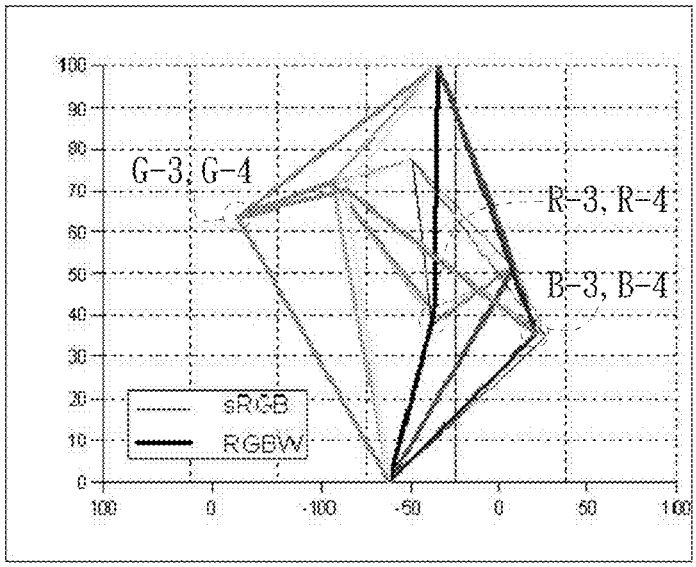

As illustrated in FIG. 9B, when the scheme of dynamically adjusting the backlight output intensity and generating the white color signal adjust ratio W is used, the pure color luminance and chromaticity displayed by the RGBW display apparatus is no longer worse than that displayed by the conventional RGB display apparatus. As seen from FIG. 9B that, the red pure color (R-4), the green pure color (G-4) and the blue pure color (B-4) in the present RGBW display apparatus respectively are nearly overlapped with the the red pure color (R-3), the green pure color (G-3) and the blue pure color (B-3) in the conventional RGB display apparatus, and therefore the present invention can make the displayed pure color luminance and chromaticity of the RGBW display apparatus be no longer worse than that of the conventional RGB display apparatus.

In the CIELAB color space, the larger of a* value appears more red color, and the smaller of a* appears more green color. The larger of b* value appears more yellow color, and the smaller of b* value appears more blue color. The larger of L* value appears more white color, and the smaller of L* value appears more black color.

Figure 10A:
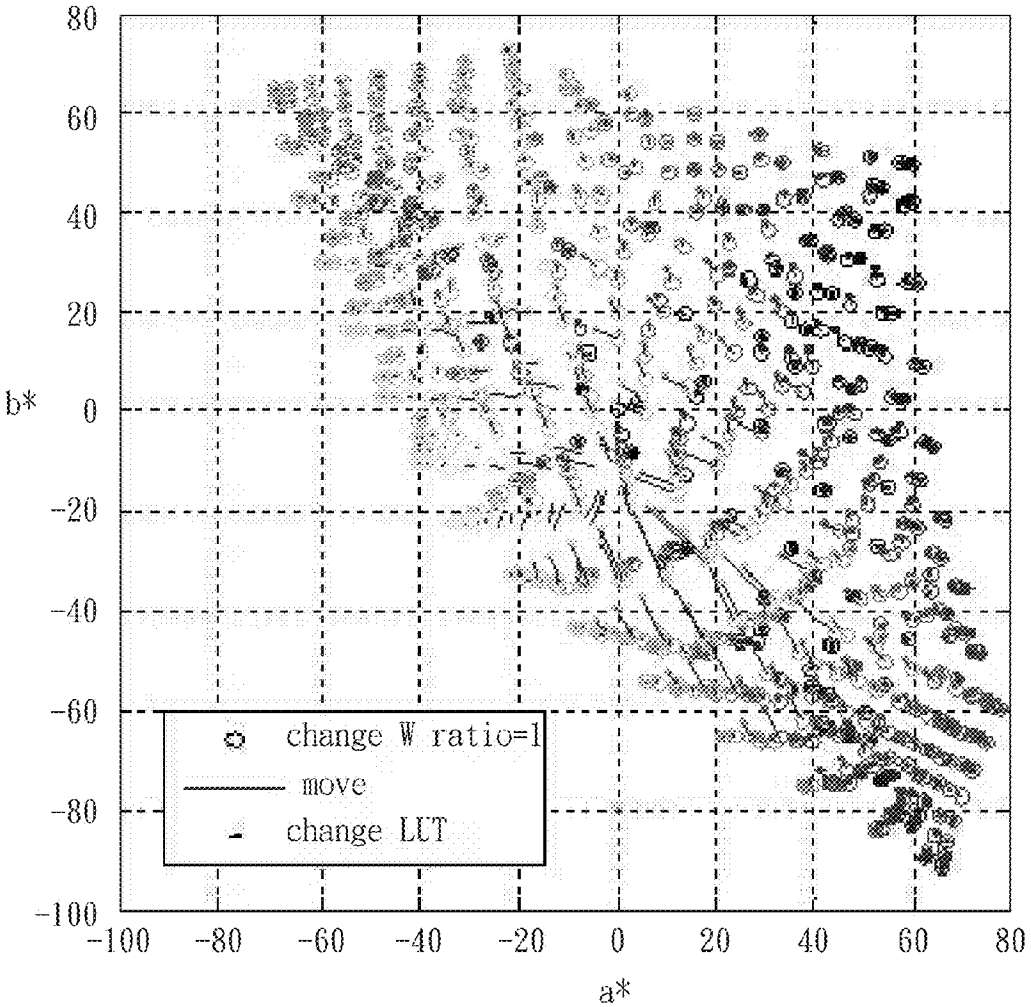
FIGS. 10A and 10B respectively are schematic views of CIELAB color spaces of the RGBW display apparatus without performing white color signal adjustment (W ratio=1) and do performing the conventional four color adjustment (change LUT)
Figure 10B:
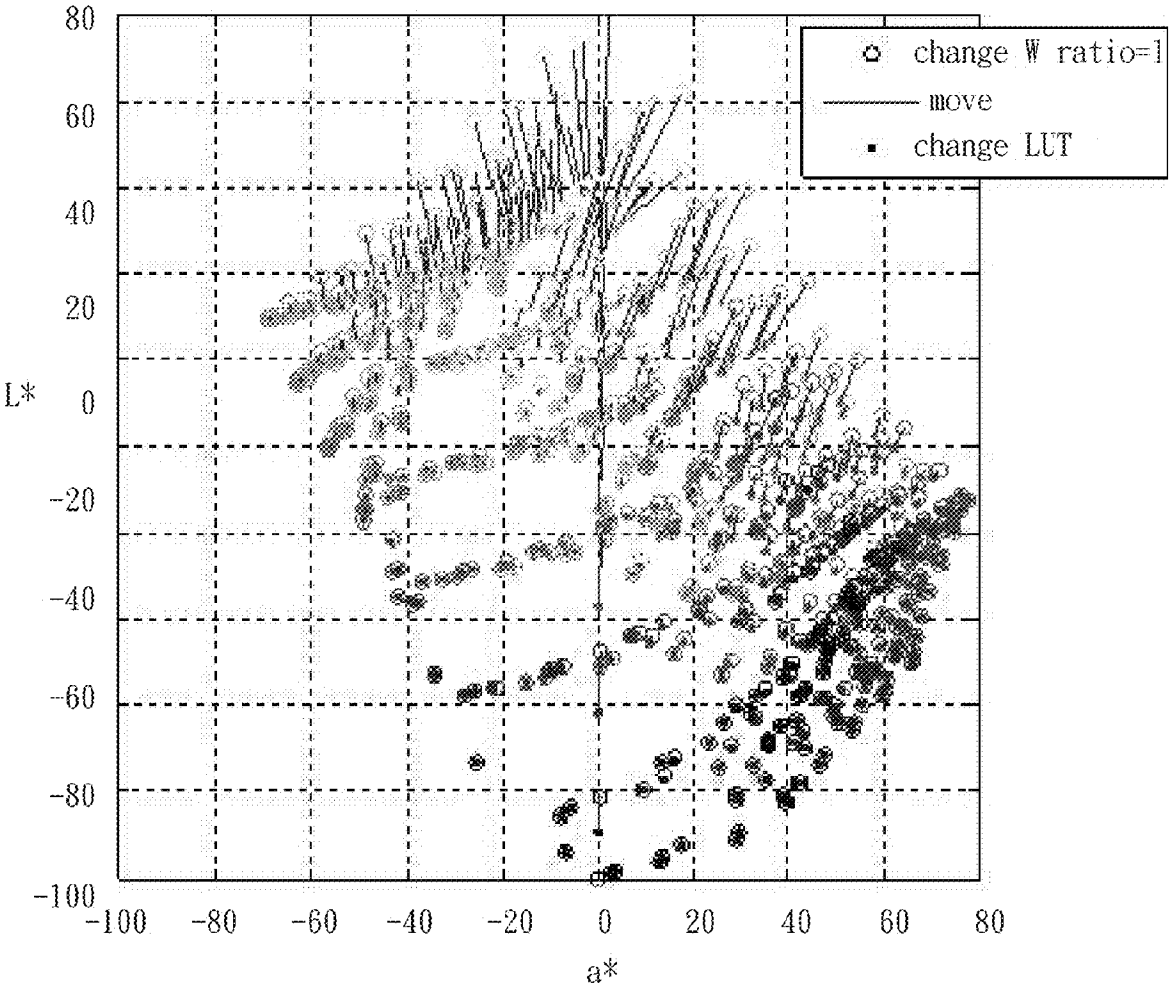

Referring to FIGS. 10A and 10B, showing schematic views of CIELAB color spaces in the situations of the RGBW display apparatus without performing the white color signal adjustment (W ratio=1) and do performing the conventional four color adjustment (i.e., change lookup table (LUT)) respectively. In FIGS. 10A and 10B, each hollow circle represents a color space position of a pixel whose white color signal without being adjusted, each solid circle represents a color space position of the pixel whose color signals are adjusted by the conventional four color adjustment solution, and each blue solid line represents a position difference between the two different situations.

It is found from FIG. 10A that, a chromaticity difference between the RGBW display apparatus without performing the white color signal adjustment and using the conventional four color adjustment is not obvious. However, as seen from FIG. 10B, when the RGBW display apparatus does not perform the white color signal adjustment, the brightness L* value of the image is close to the maximum value of 100, whereas, after performing the conventional four color adjustment, the brightness L* value of the image will fall down to less than 80. That is, when the RGBW display apparatus does not perform the white color signal adjustment, the whole image is too bright and then causing an unnatural image.

Figure 11A:
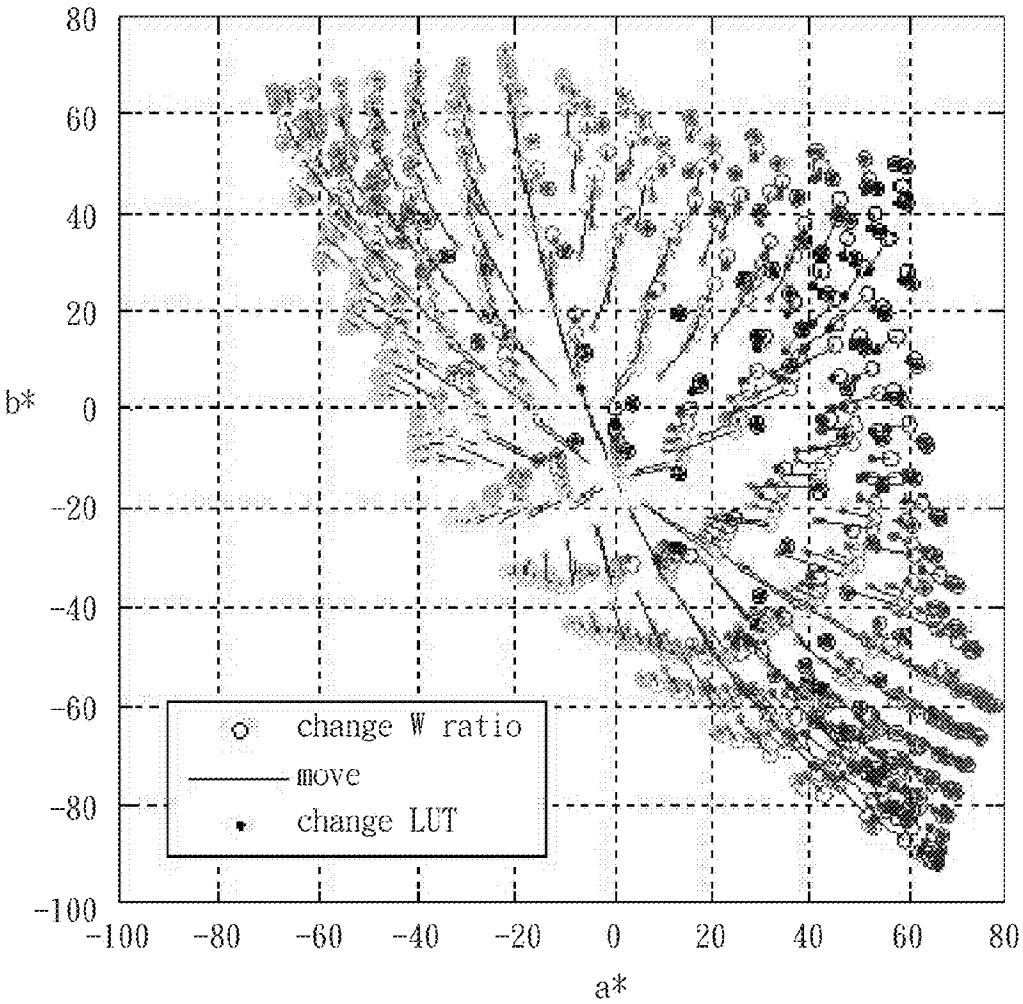
FIGS. 11A and 11B respectively are schematic views of CIELAB color spaces of the RGBW display apparatus performing white color signal adjustment (change W ratio) and performing the conventional four color adjustment (change LUT).
Figure 11B:
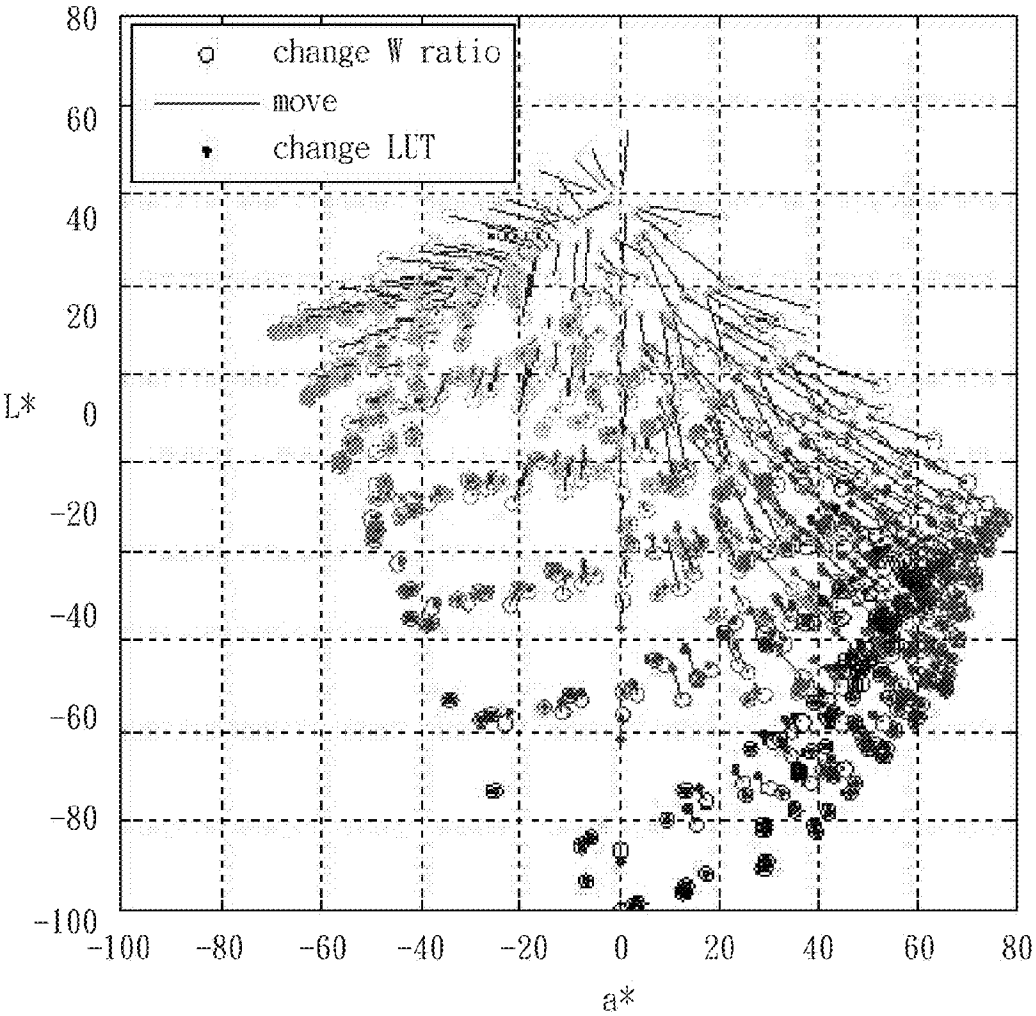

Referring to FIGS. 11A and 11B, showing schematic views of CIELAB color spaces in the situations of the RGBW display apparatus performing the white color signal adjustment (i.e., change W ratio) and performing the conventional four color adjustment (i.e., change LUT) respectively. As seen from FIG. 11A, a chromaticity difference between the RGBW display apparatus performing the white color signal adjustment and the conventional four color adjustment is not obvious. However, as seen from FIG. 11B, when the RGBW display apparatus performs the white color signal adjustment, the brightness L* value of the image also can fall down to about 80, and when the RGBW display apparatus performs the conventional four color adjustment the brightness L* value of the image will fall down to less than 80. That is, when the RGBW display apparatus performs the white color signal adjustment, the brightness of the whole image is similar to that after performing the conventional four color adjustment.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A four-primary-color display apparatus comprising:

a four-color mapping unit for receiving a plurality of three-color image input signals and generating a plurality of corresponding mapping scale ratios and thereby generating a plurality of corresponding four-color image output signals respectively mapping from the three-color image input signals, wherein each of the four-color image output signals comprises a first color signal, a second color signal, a third color signal and a white color signal;

a dynamic backlight control unit electrically connected to the four-color mapping unit for receiving the mapping scale ratios, and thereby outputting a backlight adjust signal and a white color signal adjust ratio, wherein the white color signal adjust ratio is for updating the white color signal and is dynamically calculated according to the mapping scale ratios, and the four-color mapping unit operatively adjusts the white color signal to be an updated white color signal according to the white color signal adjust ratio but does not update the generated first through third color signals, wherein the updated white color signal is obtained by multiplying the white color signal by the white color signal adjust ratio;

a backlight module electrically connected to the dynamic backlight control unit and for receiving the backlight adjust signal and thereby generating a backlight output intensity;

a source driver electrically connected to the four-color mapping unit and for receiving the not-updated first through third color signals and the updated white color signal, and thereby generating a plurality of data signals according to the received not-updated first through third color signals and updated white color signal; and a pixel array electrically connected to the source driver and for displaying an image according to the data signals and the backlight output intensity, wherein: if one of the three-color image input signals is close to pure color, the corresponding mapping scale ratio is near to 1; if one of the three-color image input signals is impure color, the corresponding mapping scale ratio is near to 2.

2. The four-primary-color display apparatus according to claim 1, wherein the first color signal, the second color signal and the third color signal respectively are a red color signal, a green color signal and a blue color signal.

3. The four-primary-color display apparatus according to claim 1, wherein the dynamic backlight control unit comprises:

a scale ratio analyzing unit for computing the mapping scale ratios and thereby outputting an analyzing value and the white color signal adjust ratio; and a backlight adjust lookup table electrically connected to the scale ratio analyzing unit and for receiving the analyzing value and converting the analyzing value into the backlight adjust signal.

4. The four-primary-color display apparatus according to claim 1, wherein the backlight module comprises:

a backlight driving unit for receiving the backlight adjust signal and generating a pulse width modulation signal; and a backlight generating unit electrically connected to the backlight driving unit and for receiving the pulse width modulation signal and thereby generating the backlight output intensity.

5. The four-primary-color display apparatus according to claim 1, further comprising:

a gate driver for outputting a plurality of gate signals to enable the pixel array to receive the data signals and thereby cooperative with the backlight output intensity to display the image.

6. A four-primary-color display apparatus comprising:

a four-color mapping unit for receiving a plurality of three-color image input signals and mapping the three-color image input signals to a plurality of four-color image output signals respectively, wherein each of the four-color image output signals comprises a first color signal, a second color signal, a third color signal and a white color signal;

a saturation mapping unit for receiving the three-color image input signals and mapping the received three-color image input signals to be a plurality of saturation values;

a dynamic backlight control unit electrically connected to the saturation mapping unit and for receiving the saturation values and thereby outputting a backlight adjust signal and a white color signal adjust ratio, wherein the white color signal adjust ratio is for updating the white color signal and is dynamically calculated according to the saturation values, and the four-color mapping unit operatively adjusts the white color signal to be an updated white color signal according to the white color signal adjust ratio but does not update the first through third color signals, wherein the updated white color signal is obtained by multiplying the white color signal by the white color signal adjust ratio;

a backlight module electrically connected to the dynamic backlight control unit and for receiving the backlight adjust signal and thereby generating a backlight output intensity;

a source driver electrically connected to the four-color mapping unit and for receiving the not-updated first through third color signals together with the updated white color signal outputted from the four-color mapping unit and thereby generating a plurality of data signals; and a pixel array electrically connected to the source driver and for displaying an image according to the data signals and the backlight output intensity.

7. The four-primary-color display apparatus according to claim 6, wherein the first color signal, the second color signal and the third color signal respectively are a red color signal, a green color signal and a blue color signal.

8. The four-primary-color display apparatus according to claim 6, wherein the dynamic backlight control unit comprises:

a saturation value analyzing unit for computing the saturation values and thereby outputting an analyzing value and the white color signal adjust ratio; and a backlight adjust lookup table electrically connected to the saturation value analyzing unit and for receiving the analyzing value and converting the analyzing value into the backlight adjust signal.

9. The four-primary-color display apparatus according to claim 6, wherein the backlight module comprises:

a backlight driving unit for receiving the backlight adjust signal and thereby generating a pulse width modulation signal; and a backlight generating unit electrically connected to the backlight driving unit and for receiving the pulse width modulation signal and thereby generating the backlight output intensity.

10. The four-primary-color display apparatus according to claim 6, wherein the saturation mapping unit is for mapping each of the three-color image input signals to be a hue saturation luminance (HSL) color gamut.

11. The four-primary-color display apparatus according to claim 6, further comprising:

a gate driver for outputting a plurality of gate signals to enable the pixel array to receive the data signals and thereby cooperative with the backlight output intensity to display the image.

12. A control method of a four-primary-color display apparatus comprising steps of:

receiving a plurality of three-color image input signals;

mapping the three-color image input signals respectively to be a plurality of four-color image output signals according to a pre-mapping lookup table, wherein each of the four-color image output signals comprises a first color signal, a second color signal, a third color signal and a white color signal;

mapping the three-color image input signals to be a plurality of saturation values;

computing the saturation values and thereby outputting a backlight adjust signal and a white color signal adjust ratio, wherein the white color signal adjust ratio is dynamically calculated according to the saturation values and is for updating the white color signal;

controlling a backlight module to generate a backlight output intensity according to the backlight adjust signal;

adjusting the white color signal to be an updated white color signal according to the white color signal adjust ratio while not updating the first through third color signals, wherein the updated white color signal is obtained by multiplying the white color signal by the white color signal adjust ratio; and displaying an image on a pixel array according to the backlight output intensity and the not-updated first through third color signals together with the updated white color signal.

13. The control method of a four-primary-color display apparatus according to claim 12, wherein the first color signal, the second color signal and the third color signal respectively are a red color signal, a green color signal and a blue color signal.

14. The four-primary-color display apparatus according to claim 1, wherein the dynamic backlight control unit compute all of the mapping scale ratios and then determine a frame is either a pure color frame or an impure color frame, if the frame is determined to be the pure color frame, the backlight module increase the backlight output intensity; and if the frame is determined to be near the impure color frame, the backlight module decrease the backlight output intensity.

* * * * *